US006241235B1

(12) United States Patent
Schmidt-Kretschmer

(10) Patent No.: US 6,241,235 B1
(45) Date of Patent: Jun. 5, 2001

(54) APPARATUS FOR SEPARATING PRINTED MEDIA

(75) Inventor: Michael Schmidt-Kretschmer, Lehnitz (DE)

(73) Assignee: Francotyp-Postalia AG & Co., Birkenwerder (DE)

( * ) Notice: Subject to any disclaimer, the term of this patent is extended or adjusted under 35 U.S.C. 154(b) by 0 days.

(21) Appl. No.: 09/368,645

(22) Filed: Aug. 5, 1999

(30) Foreign Application Priority Data

Aug. 5, 1998 (DE) ..... 198 36 235

(51) Int. Cl.[7] ..... B65H 5/00

(52) U.S. Cl. ..... 271/2; 271/119; 271/258.01; 271/258.02

(58) Field of Search ..... 271/1, 2, 3.04, 271/3.17, 119, 120, 126, 149, 256, 258.01, 258.02; 101/35, 36

(56) References Cited

U.S. PATENT DOCUMENTS

| | | | | |
|---|---|---|---|---|
| 3,828,634 | * | 8/1974 | Luperti | 271/2 X |
| 4,030,722 | | 6/1977 | Irvine et al. . | |
| 4,083,555 | | 4/1978 | Irvine et al. . | |
| 4,529,187 | | 7/1985 | Einem et al. . | |
| 4,573,673 | | 3/1986 | Haug . | |
| 4,928,946 | * | 5/1990 | Svyatsky et al. | 271/122 X |
| 4,930,764 | * | 6/1990 | Holbrook et al. | 271/2 X |
| 5,112,037 | * | 5/1992 | Holbrook | 271/2 |
| 5,244,197 | * | 9/1993 | Helmstadter | 271/121 X |
| 5,664,771 | | 9/1997 | Nagatani et al. . | |
| 5,769,408 | | 6/1998 | Selak et al. . | |
| 5,946,996 | * | 9/1999 | Oussani, Jr. et al. | 83/444 |
| 5,954,324 | | 9/1999 | Rehberg et al. . | |
| 5,957,598 | * | 9/1999 | Berkers et al. | 271/250 X |
| 6,005,212 | * | 12/1999 | Van Lierde et al. | 271/265.02 X |
| 6,050,054 | * | 4/2000 | Van Lierde et al. | 271/171 X |

FOREIGN PATENT DOCUMENTS

| | | |
|---|---|---|
| 26 21 295 A1 | 11/1976 | (DE) . |
| 196 05 106 A1 | 8/1996 | (DE) . |
| 196 05 017 A1 | 8/1997 | (DE) . |
| 0 057 810 A1 | 8/1982 | (EP) . |
| 0 376 520 A2 | 7/1990 | (EP) . |
| 0 787 672 A2 | 8/1997 | (EP) . |

* cited by examiner

*Primary Examiner*—Christopher P. Ellis
*Assistant Examiner*—Patrick Mackey
(74) *Attorney, Agent, or Firm*—Herbert L. Lerner; Laurence A. Greenberg; Werner H. Stemer

(57) ABSTRACT

An apparatus separates printed media, especially letters or envelopes, which are disposed as stacks between a spring-mounted curved pressure plate and drive rolls as well as a guide plate inclined slightly to the rear. Cylindrical envelope surfaces of the drive rolls project through openings in the guide plate. The printed media are transported away to the side. Such an apparatus is used in mail processing systems for reliably pre-separating and separating the printed media with the lowest possible technical outlay and space requirement. The apparatus includes a pre-separating area with drive-roll combinations having different coefficients of friction and a common, separate drive with freewheeling as well as a separating area with separating elements, a sensor for detecting printed media, an ejection-roll pair on the outlet side and a common, separate drive. The sensor is disposed in the vicinity of the separating elements and is linked electrically to the drive for the drive-roll combinations, in such a way that the drive is switched to freewheeling when the start of a printed medium is detected and is switched on when the end of a printed medium is detected. In this way, a jam upstream of the separating area is effectively avoided.

26 Claims, 6 Drawing Sheets

APPARATUS FOR SEPARATING PRINTED MEDIA

BACKGROUND OF THE INVENTION

Field of the Invention

The invention relates to an apparatus for separating printed media, in particular letters or envelopes, which are fed in a stack.

The letters or envelopes may have different thicknesses and permissible formats in an irregular sequence. The processing of letters or envelopes which occur in such a manner is referred to as a mixed-mail operation.

Mail processing systems usually include a mail separating apparatus in which the letters or envelopes are fed successively in a stack, are separated and, if required, are closed, a franking and/or addressing machine with an optional balance, and a depositing apparatus, as is seen in German Utility Model DE-M 96 09 167.3.

The apparatus according to the invention is a component of a letter separating apparatus.

A configuration for pre-separating the printed media is known from German Published, Non-Prosecuted Patent Application DE 196 05 017 A1, in which the letters or envelopes are fed as a stack, vertically one behind another on one edge, and the letters or envelopes are fed laterally away from the stack to a separating apparatus. In that case, the letters or envelopes are disposed between a spring-mounted curved pressure plate and at least one drive roll, as well as a slightly rearwardly inclined guide plate. The standing area for the letters or envelopes and the guide plate are orthogonal to each other.

The drive roll has an external contour with at least one projection which extends over the length of the roll and is parallel to the axis of rotation. The envelope curve of the drive roll projects through an opening in the guide plate to such an extent that at least one projection protrudes from the opening. As a result of the projecting external contour, the stack of letters or envelopes is jogged sufficiently, and the frictional and adhesive forces counteracting the transport are overcome. The force to be introduced is set through the stroke of the drive roll. As a result of the inclination of the guide plate, a stable preferred position of the stack of letters or envelopes is achieved. The axis of the drive roll in that case is parallel to the guide plate. In that case, the problem of separation remains unsolved.

An input device for an appliance for processing sheets, such as paper money or postcards, is also known from German Published, Non-Prosecuted Patent Application DE 27 25 947 A1. That device includes at least one transport belt and at least one backing roller. The backing roller is driven in the opposite direction in relation to the transport belt. The sheets are transported from a sheet stacking point to a sheet processing point through the use of the transport belt. The backing roller is disposed in such a way that there is a gap between the cylindrical outer surface of the roller and the outer surface of the transport belt, which allows at least one of the sheets to pass.

That configuration assumes that the transport belt reaches from the region of the sheet stacking point as far as the region of the sheet processing point. The sheets are transported horizontally on the transport belt and thus sheets are continuously pushed against the backing roller. As a consequence, however, there is additionally a risk that a jam will build up at that point and, as a result, sheets can be damaged, particularly since measures for overcoming the adhesion between the letters are lacking.

The relationships are similar in a document separating apparatus according to European Patent 0 598 571 B1. As a distinction from the solution previously described, belts are used in that case instead of the backing rollers.

Finally, equipment for separating mail items is known from U.S. Pat. No. 4,615,519, in which vertically oriented letters or envelopes are deposited one behind another as a stack of letters or envelopes in a holding area. The stack of letters or envelopes is pressed against a pull-off device through the use of spring force by a thrust element guided on a carrier.

The pull-off device includes a drive roll made of rubber disks disposed at a distance one above another on a shaft. The rubber disks project partly through a guide plate located opposite the holding area and rest on the broad side surface of the front letter or envelope of the stack, with the guide plate engaging like teeth in the gaps between the rubber disks.

Due to the spring force, there is an approximately constant force between the stack of letters and the drive roll. On one hand, viewed alone, that is advantageous. On the other hand, however, it is a problem to introduce a force between the drive roll and the front letter or envelope which overcomes the adhesion and friction between the latter and the rest of the stack and the guide plate, particularly since the adhesive capacity may exhibit very great differences because of different weights, adhesive-surface size and paper finish. Once the drive roll begins to slip, the result is disruption to the automatic operation.

The letters or envelopes which are pulled off pass from the pull-off device to a cylindrical roll and a backing belt located opposite the latter and, following that, to the same combination once more. The drive roll and the two cylindrical rolls are driven jointly by a motor through a toothed belt, which also drives the backing belts through a further toothed belt. The stacked configuration of two separating pairs requires a correspondingly large amount of space and complication.

SUMMARY OF THE INVENTION

It is accordingly an object of the invention to provide an apparatus for separating printed media, which overcomes the hereinafore-mentioned disadvantages of the heretofore-known devices of this general type, which improves properties of use, which permits printed media from a stack to be pre-separated and separated reliably and in which engineering outlay and space requirements are as low as possible.

With the foregoing and other objects in view there is provided, in accordance with the invention, an apparatus for separating printed media, such as letters or envelopes, comprising a pre-separating area and a separating area; a spring-mounted curved pressure plate; a guide plate having openings formed therein; drive-roll combinations in the pre-separating area, the drive-roll combinations including drive rolls having different coefficients of friction and cylindrical envelope surfaces projecting through the openings for individually laterally transporting away stacked printed media disposed between the pressure plate and the drive rolls; a drive for the drive-roll combinations; separating elements disposed in the separating area; and a sensor disposed in the separating area in the vicinity of the separating elements for detecting printed media, the sensor linked electrically to the drive for the drive-roll combinations for switching the drive to freewheeling upon detecting a start of a printed medium and for switching on the drive upon detecting an end of a printed medium.

In accordance with another feature of the invention, the drive for the drive-roll combinations is a common, separate drive with freewheeling.

In accordance with a further feature of the invention, there is provided an outlet side, an ejection-roll pair on the outlet side, and a common, separate drive for the separating elements and the ejection-roll pair.

In accordance with an added feature of the invention, the separating elements include a drive-belt combination, a driven backing-roller combination matched to the drive-belt combination and a sliding-lever combination matched to and mounted upstream of the drive-belt combination, the sensor disposed in the vicinity of the backing-roller combination.

In accordance with an additional feature of the invention, the guide plate is a rear guide plate; a first of the drive-roll combinations includes a common shaft; the drive rolls of the first drive-roll combination include a first drive roll and a second drive roll spaced apart one above another on the common shaft and each projecting through a respective one of the openings in the rear guide plate; the first drive roll is a bottom drive roll disposed below the second drive roll and has a length matched to a smallest usual printed media format height; the second drive roll is a top drive roll shorter than and disposed at distance from the bottom drive roll matching a largest usual printed media format height; and the first and second drive rolls each have external contours with at least one identical projection extending over the length of the drive roll, parallel to an axis of rotation and formed of identical material.

In accordance with yet another feature of the invention, a second of the drive-roll combinations includes a common shaft; the drive rolls of the second drive-roll combination include a first drive roll and a second drive roll spaced apart one above another on the common shaft and each projecting through a respective one of the openings in the rear guide plate; the first drive roll is a bottom drive roll disposed below the second drive roll and has a length matched to a smallest printed media format height; the second drive roll is a top drive roll shorter than and disposed at distance from the bottom drive roll matching a largest usual printed media format height; the first drive roll has a given envelope circle and an external contour with at least one projection extending over the length of the drive roll and parallel to an axis of rotation; and the second drive roll is a smooth spacer roll with an envelope circle identical to the given envelope circle.

In accordance with yet a further feature of the invention, the projections in the first drive-roll combination are formed of replaceable moldings of identical material with the same given coefficient of friction, preferably polyurethane; and the at least one projection on the first drive roll of the second drive roll combination is also formed of a replaceable molding, preferably of polyurethane, and has a coefficient of friction lower than the given coefficient of friction.

In accordance with yet an added feature of the invention, the second drive roll is formed of a relatively hard commercial plastic, such as polyoxymethylene.

In accordance with yet an additional feature of the invention, the drive-roll combination s have parallel contours.

In accordance with again another feature of the invention, the guide plate is a rear guide plate, and the drive-belt combination has identical drive belts disposed equidistantly one above another and projecting through associated openings formed in the rear guide plate.

In accordance with again a further feature of the invention, the backing-roll combination is disposed opposite the drive-belt combination and has identical backing rollers disposed equidistantly one above another on a rotatable shaft.

In accordance with again an added feature of the invention, the sliding-lever combination includes a two-armed lever.

In accordance with again an additional feature of the invention, the backing-roll combination is disposed opposite the drive-belt combination and has identical backing rollers, the backing rollers are disposed equidistantly one above another on a rotatable shaft, and the backing rollers are disposed opposite gaps between the drive belts and outside the gaps; and the sliding-lever combination is disposed opposite the gaps between the drive belts, upstream of the backing rollers, and the sliding-lever combination includes a two-armed lever with free arms pointing in a direction opposite to a printed media transport direction.

In accordance with still another feature of the invention, there is provided a drive-wheel combination having drive wheels, an axially parallel deflection-wheel combination having deflection wheels, the drive belts disposed equidistantly on the drive wheels and the deflection wheels, and, if required, smooth, freewheeling supporting wheels for the drive belts disposed between the drive-wheel combination and the deflection-wheel combination.

In accordance with still a further feature of the invention, the drive belts are toothed belts and the drive wheels and the deflection wheels are toothed wheels; the drive wheels are fixed to a rotatable shaft; and the deflection wheels are fastened to a rotatable shaft.

In accordance with still an added feature of the invention, there is provided a dual support lever having free ends, fixed ends and a shaft, the shaft with the backing rollers firmly seated thereon being rotatably mounted on the free ends, the fixed ends being spring-mounted on the shaft of the dual support lever for rotation toward and away from the drive-belt combination, and the fixed ends having a tab in a pivoting range of a cam for pivoting away and locking the dual support lever; and the sliding-lever combination disposed on the shaft with the dual support lever and pivoted in the direction of the drive-belt combination by a sliding-friction clutch.

In accordance with still an additional feature of the invention, there is provided a locking device having the cam, a lever for manually operating the locking device, and a rotatable shaft to which the lever and the cam are fixed.

In accordance with another feature of the invention, the backing-roll combination is disposed opposite the drive-belt combination and has identical backing rollers disposed equidistantly one above another on a rotatable shaft; and including an ejection-roll pair having rotatable shafts, a driven ejection roll fixed to one of the rotatable shafts, an indirectly driven ejection roll fixed to another of the rotatable shafts, a rotatable spring-mounted support lever on which the other rotatable shaft is mounted, and a coupling rod articulatingly connecting the rotatable spring-mounted support lever to the locking device for achieving simultaneous deactivation and locking together with the backing rollers.

In accordance with a further feature of the invention, the indirectly driven ejection roll is shorter, by more than a largest envelope flap height of the printed media, than the driven ejection roll, and the indirectly driven ejection roll is flush with the driven ejection roll at the top.

In accordance with an added feature of the invention, the sensor is disposed directly downstream of the backing-roller combination in a printed-medium transporting direction.

In accordance with an additional feature of the invention, the common drive for the drive-roll combinations includes a motor having a motor shaft with a first pinion thereon, a rigid shaft, an intermediate wheel rotatable on the rigid shaft, and a first toothed belt coupling the first pinion to the intermediate wheel; a second freewheeling pinion fixed on the common rotatable shaft of the second drive-roll combination, and a second toothed belt coupling the intermediate wheel to the second pinion; and a third freewheeling pinion firmly fixed to the common rotatable shaft of the first drive-roll combination, and a third toothed belt coupling the second pinion to the third pinion.

In accordance with a concomitant feature of the invention, the common drive for the drive-belt combination, the backing-roller combination, the sliding-lever combination and the ejection roll pair has a second motor with a motor shaft, a pinion on the motor shaft, an intermediate wheel fixed to the rotatable shaft for the drive wheels, and a toothed belt coupling the pinion to the intermediate wheel. A fixed shaft has a drive pinion rotatably disposed thereon, and a toothed belt coupling the intermediate wheel to the drive pinion. A drive pinion is fixed on the rotatable shaft for the dual support lever for the backing-roller combination and the sliding-lever combination and a toothed belt couples the drive pinions together. A pinion is fixed together with the driven ejection roll to a rotatable shaft and a toothed belt couples the drive pinion to the pinion. The dual support lever is mounted on the shaft for rotation counter to the force of spring. The rotatable shaft is disposed on the free ends of the dual support lever, and a pinion and the backing rollers are fixed on the rotatable shaft. The sliding-lever combination is a two-armed lever mounted on the shaft for rotation counter to the force of a spring through the sliding-friction clutch. A transmission pinion is fixed to the shaft and coupled through a toothed belt to the pinion. The drive wheels are rigidly fixed to the rotatable shaft and connected through the associated drive belts to the deflection wheels. A rotatable shaft is provided to which the supporting wheels are fixed between the drive wheels and the deflection wheels.

The three rotatable shafts are mounted in a U-shaped supporting frame.

The apparatus provides drive rolls with jogging properties, separate drives in the pre-separating and separating area, a structure of the drive in the pre-separating area with freewheeling and of the drive rolls with different coefficients of friction and the placement of a sensor for detecting printed media in the pre-separated area, with the sensor being electrically coupled to the drive in the pre-separating area. As a result, no jam upstream of the pre-separating area is produced by the drive rolls in the pre-separating area, and in each case only one printed medium is transported to the subsequent equipment.

The subdivision and configuration of the drive-roll combinations in the pre-separating area permits reliable processing both of the smallest and of the largest usual letter or envelope formats.

An economical solution and good service properties are achieved due to the use of a common drive in the separating and ejection area, and coupling the two through functional levers in order to set the operating mode.

The sliding-lever combination ensures that the last printed medium in a stack is reliably gripped. The device is suitable for printed media standing on edge one behind the other on one edge as well as disposed lying flat on top of each other.

Other features which are considered as characteristic for the invention are set forth in the appended claims.

Although the invention is illustrated and described herein as embodied in an apparatus for separating printed media, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
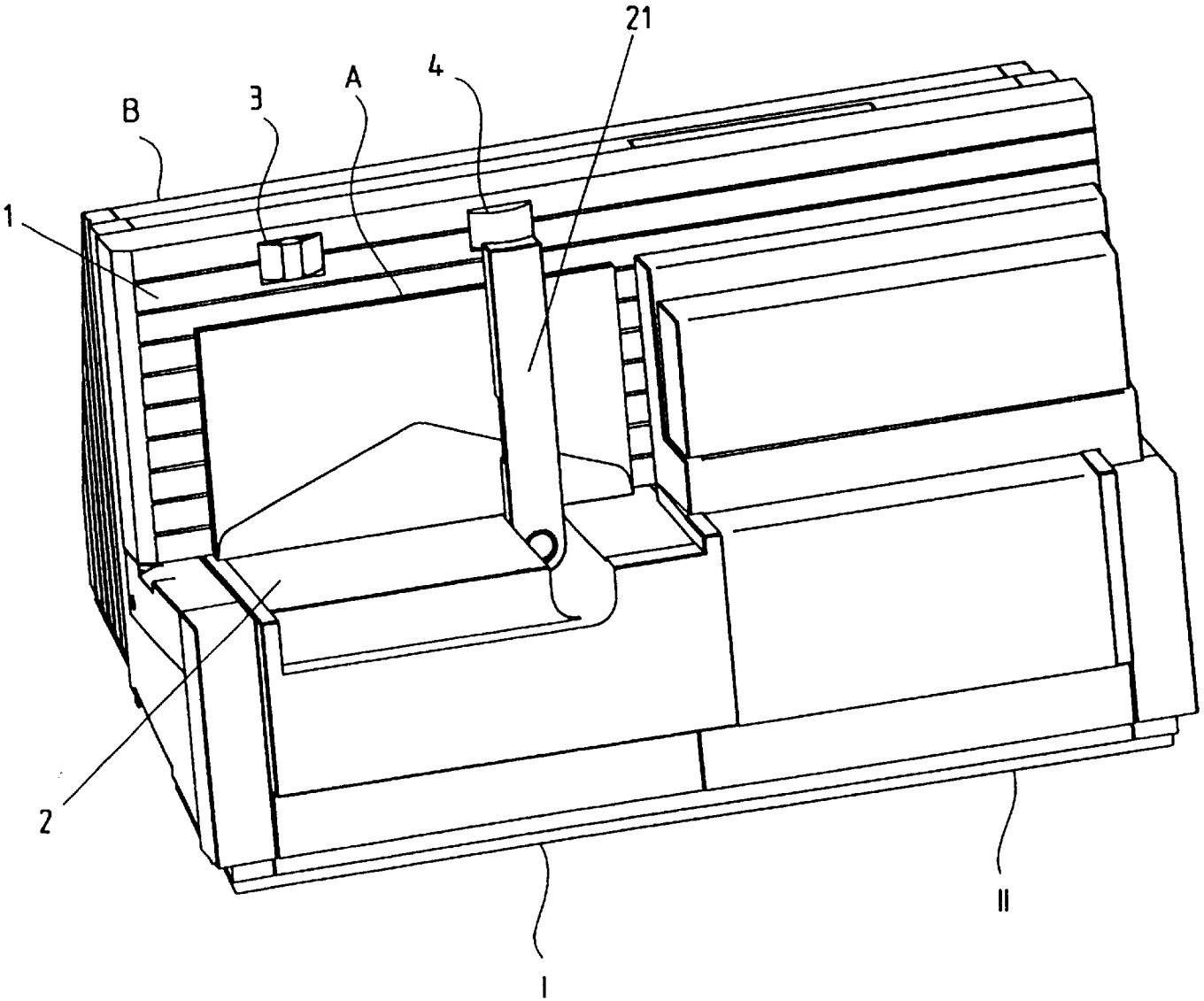
FIG. 1 is a diagrammatic, left-side perspective view of a letter separating apparatus.

Referring now in detail to the figures of the drawings, which are in diagrammatic form for ease of understanding and in which the term "letter" or "envelope" is used instead of "printed medium" for brevity, and first, particularly, to FIG. 1 thereof, there is seen a letter separating apparatus B which is subdivided functionally into a pre-separating area I and a separating area II. A rear guide plate 1, which is inclined slightly rearward, and a lower guide plate 2, which is orthogonal thereto, are provided for the purpose of guiding letters or envelopes A.

The letters A are disposed vertically as a stack with the edge of their envelope flap on the lower guide plate 2, in a force-locking manner between a curved pressure plate 21 and the rear guide plate 1. A force-locking connection is one which connects two elements together by force external to the elements, as opposed to a form-locking connection which is provided by the shapes of the elements themselves.

The curved pressure plate 21 is disposed in such a way that it can be pivoted from an operating position into a rest position and vice versa and locked. In the operating position illustrated herein, the curved pressure plate 21 assumes an orthogonal position in relation to the lower guide plate 2, and is disposed in such a way that it can be displaced toward the rear guide plate 1 under the influence of a non-illustrated spring and away from the latter. In the rest position, the curved pressure plate 21 assumes a horizontal position in a matching recess in the lower guide plate 2 and terminates flush with the latter. In this position, the curved pressure plate 21 is locked, as is seen in FIG. 2.

The letters A are pushed one after another, sliding along on the rear guide plate 1, from the pre-separating area I into the separating-area II, through the use of first and second drive-roll combinations 3, 4. The drive-roll combinations 3, 4 are disposed in such a way that their contours are parallel to each other and at the same height in relation to the lower guide plate 2. Due to their specific shaping, as will be described below, the drive-roll combinations 3, 4 have the effect of jogging the stack of letters.

Figure 2:
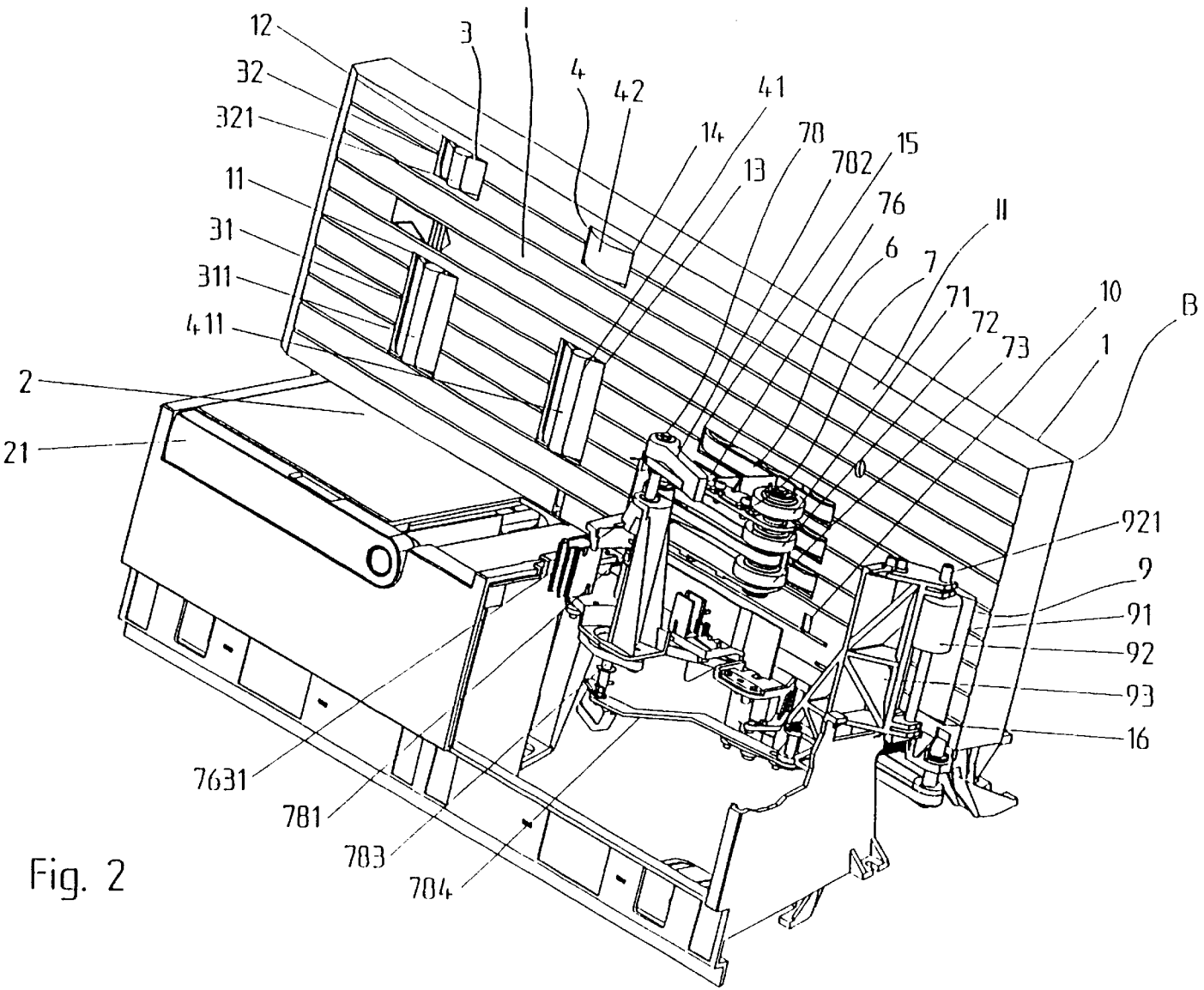
FIG. 2 is an enlarged, partly broken-away view of the apparatus according to FIG. 1.
Figure 3:
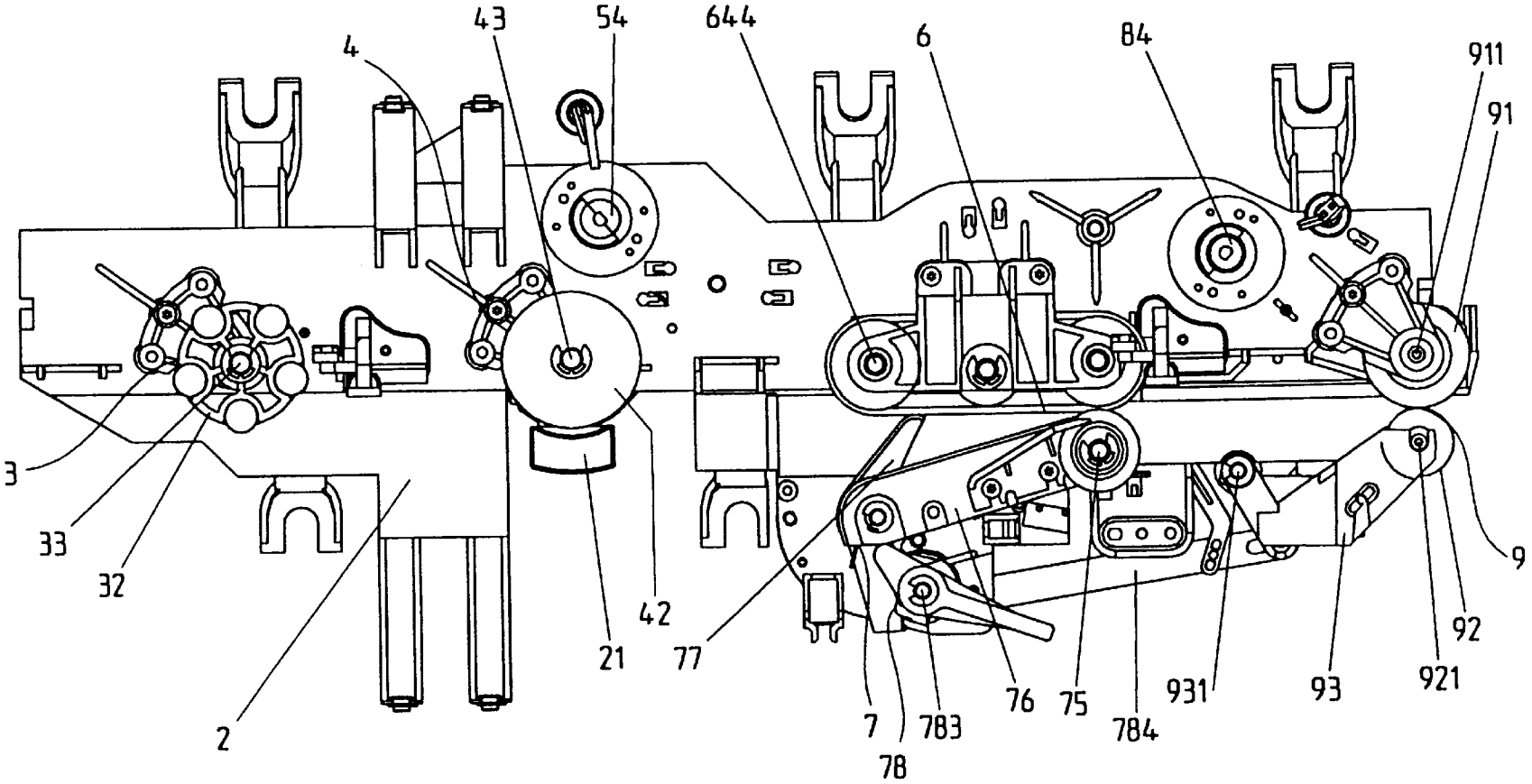
FIG. 3 is a partial plan view of the apparatus according to FIG. 2.
Figure 4:
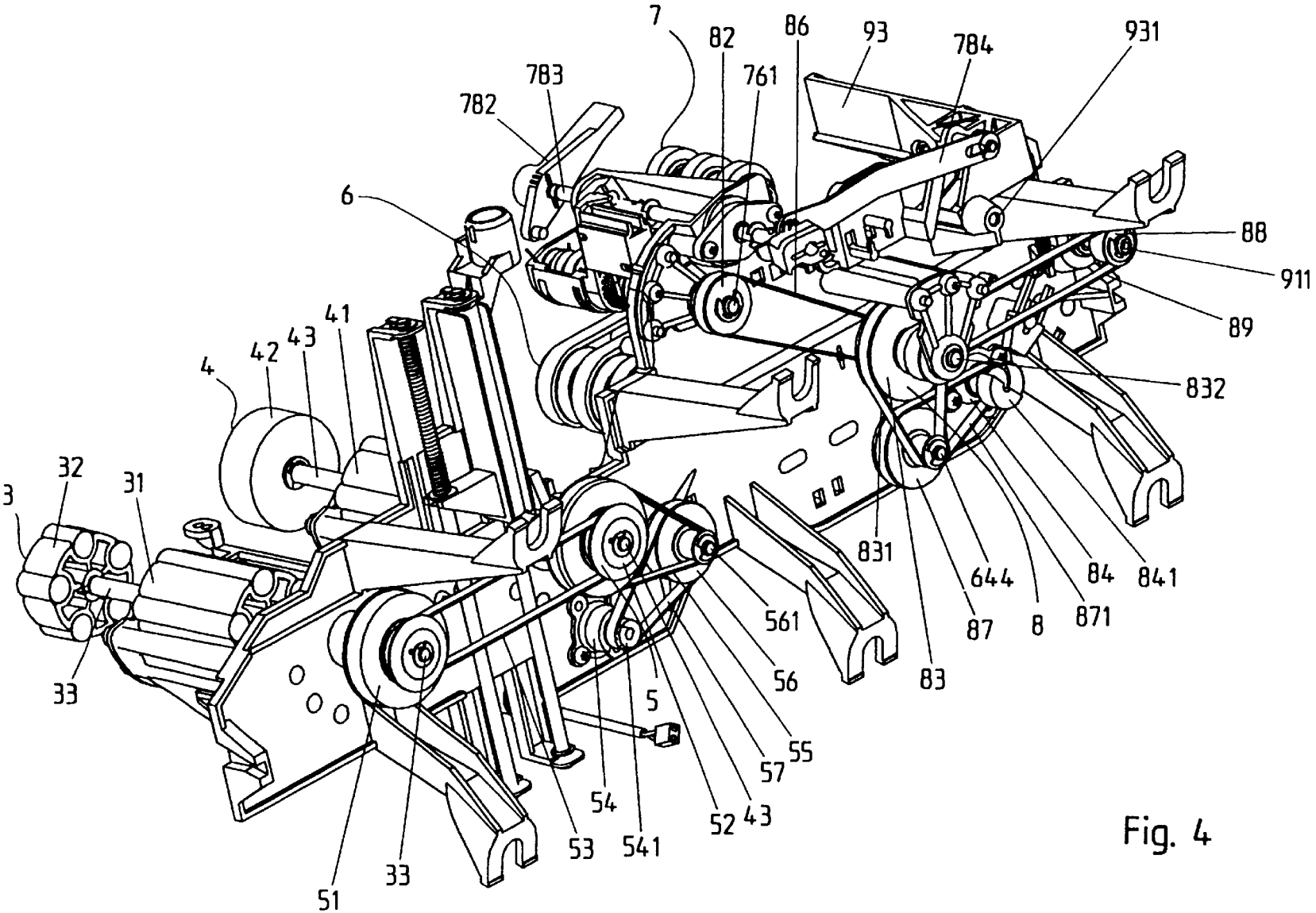
FIG. 4 is a bottom plan view showing details of a drive.

According to FIG. 2, the first drive-roll combination 3 includes a first lower drive roll 31 with projections 311 and a second upper drive roll 32 with projections 321. The two drive rolls 31, 32 have identical contours in plan view and are disposed at a distance from each other on a common shaft 33, as is also seen in FIGS. 3 and 4. The drive roll 31 projects through an opening 11 and the drive roll 32 projects through an opening 12 in the rear guide plate 1.

The second drive-roll combination 4 includes a first lower drive roll 41 with projections 411 and a second upper drive roll 42 without projections, which is constructed as a smooth spacer roll. The two drive rolls 41, 42 are likewise disposed on a common shaft 43 at a distance from each other. An external contour of the second drive roll 42 coincides with an envelope circle of the first drive roll 41 in plan view. The drive roll 41 projects through an opening 13 and the drive roll 42 projects through an opening 14 in the rear guide plate 1.

The length of the lower drive rolls 31, 41 is matched to the height of the smallest usual letter formats. The lower drive rolls 31, 41 are longer than the upper drive rolls 32, 42. The distance between the lower and upper drive rolls 31, 41, 32, 42, is selected in such a way that the largest usual letter formats are still gripped in the upper portion.

The projections 311, 321, 411 extend over the entire length of the roll, parallel to the axis of rotation, and are formed of replaceable cylindrical moldings, preferably made of polyurethane. The projections 311 and 321 of the drive rolls 31, 32 of the first drive-roll combination 3 are made of identical materials, in particular they have the same coefficient of friction. The material for the projections 411 of the lower drive roll 41 of the second drive-roll combination 4 is selected in such a way that the coefficient of friction is lower than that of its precursors. The upper drive roll 42, which is constructed as a smooth spacer roll, is formed of a relatively hard commercial or engineering plastic, for example polyoxymethylene, which is expediently used for the other basic roll bodies as well.

When the drive-roll combinations 3, 4 rotate, firstly the stack of letters is jogged by the projections 311, 321, 411 of the drive rolls 31, 32, 41, and secondly the letters A are individually pushed away laterally in accordance with the coefficient of friction. Since the projections 311, 321 have a greater coefficient of friction than those following, the initial tempo of the lateral movement is also determined by the former. The projections 411 on the lower drive roll 41 only have a supporting effect for the movement, and the upper drive roll 42 serves primarily to reduce friction and maintain spacing.

In the separating area II, an individual letter A is led, through the use of a drive-belt combination 6 and a driven backing-roller combination 7 matched to the latter, as well as a sliding-lever combination 77 which is mounted upstream in the opposite direction to the letter-transporting direction, past a sensor 10 for letter detection, to an ejection-roll pair 9, as is also seen in FIGS. 3, 5, 6A and 6B. The sensor 10 is disposed directly downstream of the backing-roller combination 7 in the printed-medium transport direction.

When the start of a letter is detected by the sensor 10, the latter produces a signal which is used to change over the drive-roll combinations 3, 4 from driving to idling. At the end of a letter, the sensor 10 correspondingly produces a signal to change over from idling to driving. In this way, the next letter A is pushed out of the feeding or pre-separating area I into the separating area II only when the current letter A has left the latter. This rules out the formation of a jam.

Figure 5:
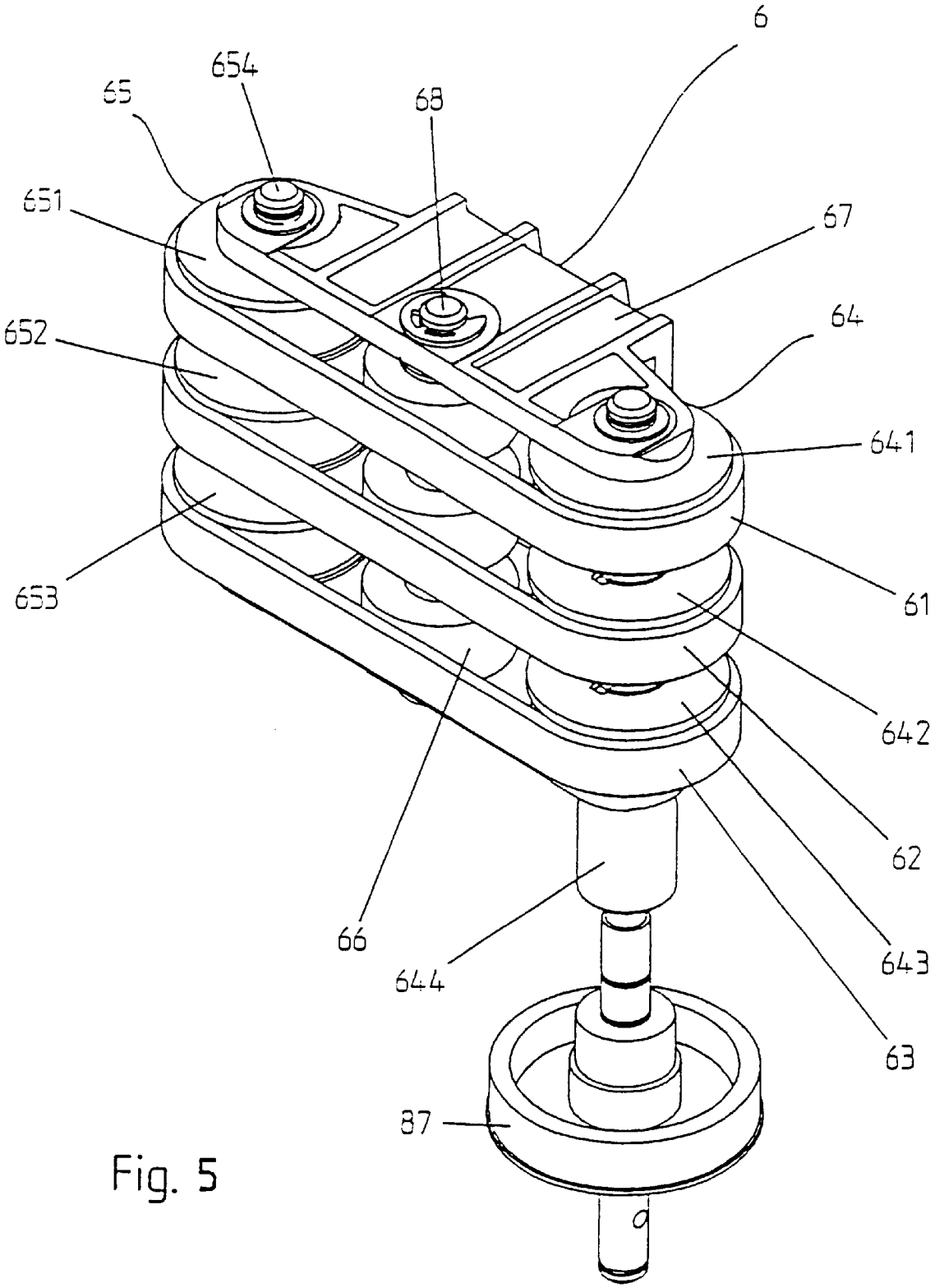
FIG. 5 is a further enlarged, right-front perspective view of a drive-belt combination.

The drive-belt combination 6 has three identical drive belts 61, 62, 63 shown in FIG. 5, which are disposed equidistantly above one another and project through associated openings 15 in the rear guide plate 1 seen in FIG. 2.

Figure 6B:
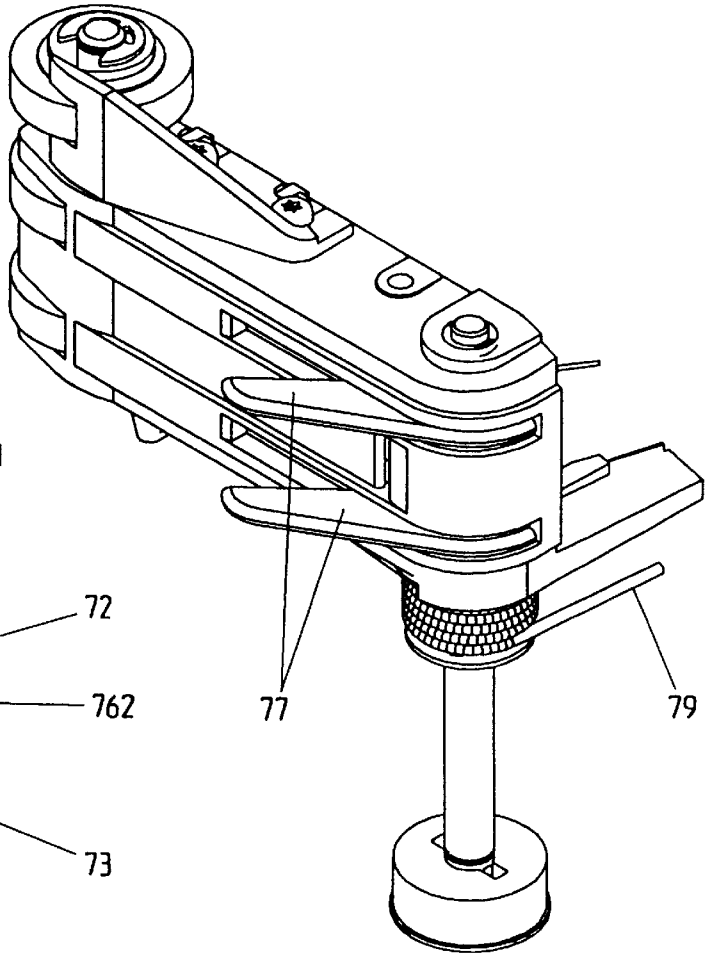
FIGS. 6A and 6B are respective right-front and left-rear perspective views of a backing-roller and sliding-lever combination.
Figure 6A:
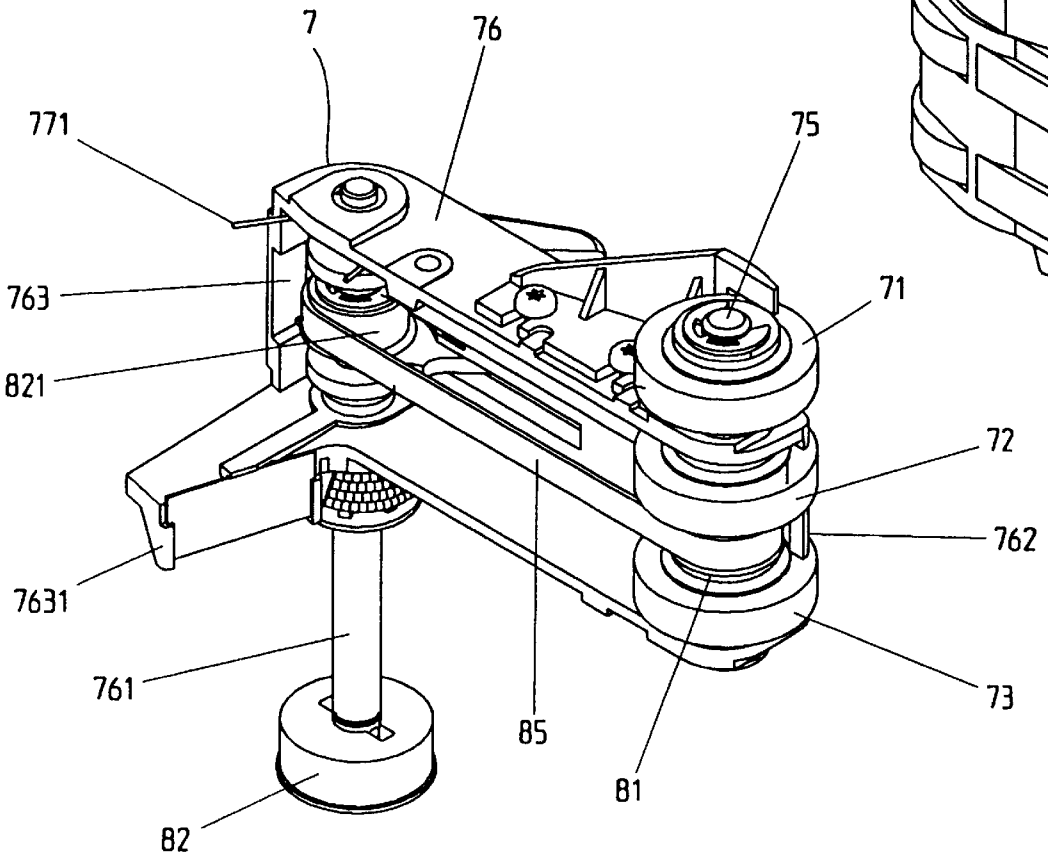

The backing-roller combination 7 has three backing rollers 71, 72, 73 as a counterpart to the drive-belt combination 6, which are similarly disposed equidistantly on a fourth shaft 75 as is seen in FIG. 6A. The top backing roller 71 is located above the level of the top drive belt 61, and the remaining two backing rollers 72, 73 are located opposite associated gaps between the drive belts 61, 62, 63 as is seen in FIG. 2.

The shaft 75 with the backing rollers 71, 72, 73 firmly seated thereon is rotatably mounted on free ends 762 of an appropriately shaped dual support lever 76. The dual support lever 76 is in turn spring-rotatably mounted at its other ends 763 on a driven fifth shaft 761, as is seen in FIG. 6A. In this way, the dual support lever 76 with its free ends 762 can be pivoted toward the drive-belt combination 6 and away from the latter again.

In addition, the ends 763 of the dual support lever 76, which are on mounted on the shaft 761, are provided with a tab 7631 that is located in a pivoting range of a cam 781. The cam 781 is a component of a locking device 78, which can be actuated manually through the use of a lever 782. The cam 781, together with the lever 782, is fixed to a sixth rotatable shaft 783. The locking device 78 is used to pivot out and lock the dual support lever 76 in the pivoted-out state.

The ejection roll pair 9 includes a driven ejection roll 91 and an indirectly driven ejection roll 92. The driven ejection roll 91 is fastened to one seventh rotatable shaft 911 behind the rear guide plate 1 and its periphery projects through an associated opening 16 in the guide plate 1, as is seen in FIGS. 2, 3 and 4.

The indirectly driven ejection roll 92 is likewise fastened to another seventh rotatable shaft 921, which is in turn mounted on a rotatable, spring-mounted support lever 93. The support lever 93 is mounted on a shaft 931 and is connected in an articulated manner, through a coupling rod 784, to the shaft 783 of the locking device 78. This achieves simultaneous deactivation and locking together with the backing rollers 71, 72, 73 when the lever 782 is operated appropriately, as is seen in FIGS. 3 and 4.

The indirectly driven ejection roll 92 is shorter, by more than the greatest height of the envelope flaps of the letters A, than the driven ejection roll 91 and is disposed to be flush with the latter at the top. As a result, premature closure of the letters by the ejection-roll pair 9, with the risk of forming bulges on the envelope flaps, is avoided.

In the plan view according to FIG. 3, it is possible to see a first motor 54 for driving the drive-roll combinations 3, 4 and a second motor 84 for driving the drive-belt combination 6, the backing-roller combination 7 as well as the ejection-roll pair 9 and the sliding-lever combination 77.

FIG. 4 illustrates connections between the motors 54, 84 and the drive devices for the letters A. For this purpose, a perspective view from below has been selected and rotated through 90° to the rear.

In a common drive 5 for the drive-roll combinations 3, 4, a first pinion 541 on a motor shaft of the first motor 54 is coupled, through a toothed belt 57, to an intermediate wheel 56 which is rotatably disposed on a rigid shaft 561. The intermediate wheel 56 is further connected, through a toothed belt 55, to a second pinion 52 which is disposed to be fixed on the common, rotatable shaft 43 of the second drive-roll combination 4. The pinion 52 is connected, through a toothed belt 53, to a third pinion 51, which is likewise disposed to be fixed on the common, rotatable shaft 33 of the first drive-roll combination 3.

The pinion 51 and the pinion 52 are equipped with a freewheel, in such a way that rotation of the drive-roll combinations 3, 4 is still possible when the motor 54 is switched off, if friction between the letter A and the drive rolls 31, 32, 41, 42 is sufficient. This case could arise when a letter has just been gripped by the drive-belt combination 6 and the backing-roller combination 7 and is still resting on at least one roll combination 3, 4. The next letter A can only be moved when the motor 54 is switched on again.

The second motor 84 is provided for a common drive 8 of the drive-belt combination 6, the backing-roller combination 7, the sliding-lever combination 77 and the driven ejection roll 91. The second motor 84 has a motor shaft on which a pinion 841 is seated. The pinion 841 is coupled, through a toothed belt 871, to an intermediate wheel 87. The intermediate wheel 87 and a drive-wheel combination 64 are disposed to be fixed on a first rotatable shaft 644, as is seen in FIG. 5. The intermediate wheel 87 is further connected, through a toothed belt 831, to a drive pinion 83, which is rotatably disposed on a fixed shaft 832.

In addition, the drive pinion 83 is firstly coupled, through a toothed belt 86, to a drive pinion 82 and is secondly coupled, through a toothed belt 89, to a pinion 88. The drive pinion 82 is disposed to be fixed on a rotatable shaft 761, together with the backing-roller combination 7, as is also seen in FIGS. 6A and 6B. The pinion 88 is disposed to be fixed on the rotatable shaft 911, together with the driven ejection roll 91.

According to FIG. 5, the drive-belt combination 6 has the three drive belts 61, 62, 63 as well as a U-shaped support frame 67, in which the first shaft 644, a second shaft 654 and a third shaft 68 are rotatably mounted. Drive wheels 641, 642, 643 assigned to the drive belts 61, 62, 63 are fastened to the shaft 644. Corresponding deflection wheels 651, 652, 653 are fastened to the shaft 654. Three supporting wheels 66, which are intended to ensure uniform contact between the drive belts 61, 62, 63 and the letter A, are correspondingly fixed to the shaft 68. All of the above-mentioned wheels are toothed, as counterparts to the drive belts 61, 62, 63.

According to FIGS. 6A and 6B, the dual support lever 76 for the backing rollers 71, 72, 73 is rotatably mounted on the shaft 761 in such a way that it can rotate counter to the force of a spring 79. In addition, the sliding-lever combination 77, in the form of a two-armed lever, is mounted on the shaft 761 and biased counter to a spring 771 through a sliding-friction clutch. Finally, a transmission pinion 821 is further fixed to the shaft 761 and is driven by the drive pinion 82 through the shaft 761. The rotational movement of the transmission pinion 821 is transmitted, through a toothed belt 85, to a pinion 81 which is fixed to the rotatable shaft 75, together with the backing rollers 71, 72, 73. The shaft 75 is rotatably mounted on the free ends 762 of the dual support lever 76.

As can be easily seen, only a corresponding rotation of the above-described device is necessary for the flat printing media transport.

I claim:

1. An apparatus for separating printed media, comprising:

a pre-separating area and a separating area;

a spring-mounted curved pressure plate;

a guide plate having openings formed therein;

drive-roll combinations in said pre-separating area, said drive-roll combinations including drive rolls having different coefficients of friction and cylindrical envelope surfaces projecting through said openings for individually laterally transporting away stacked printed media disposed between said pressure plate and said drive rolls;

a drive for said drive-roll combinations;

separating elements disposed in said separating area; and a sensor disposed in said separating area in the vicinity of said separating elements for detecting printed media, said sensor linked electrically to said drive for said drive-roll combinations for switching said drive to freewheeling upon detecting a start of a printed medium and for switching on said drive upon detecting an end of a printed medium.

2. The apparatus according to claim 1 wherein said drive for said drive-roll combinations is a common, separate drive with freewheeling.

3. The apparatus according to claim 1, including an outlet side, an ejection-roll pair on said outlet side, and a common, separate drive for said separating elements and said ejection-roll pair.

4. The apparatus according to claim 1, wherein said separating elements include a drive-belt combination, a driven backing-roller combination matched to said drive-belt combination and a sliding-lever combination matched to and mounted upstream of said drive-belt combination, said sensor disposed in the vicinity of said backing-roller combination.

5. The apparatus according to claim 1, wherein:

said guide plate is a rear guide plate;

one of said drive-roll combinations includes a common shaft;

said drive rolls of said one drive-roll combination include a first drive roll and a second drive roll spaced apart one above another on said common shaft and each projecting through a respective one of said openings in said rear guide plate;

said first drive roll is a bottom drive roll disposed below said second drive roll and has a length matched to a smallest usual printed media format height;

said second drive roll is a top drive roll shorter than and disposed at distance from said bottom drive roll matching a largest usual printed media format height; and said first and second drive rolls each have external contours with at least one identical projection extending over the length of said drive roll, parallel to an axis of rotation and formed of identical material.

6. The apparatus according to claim 1, wherein:

said guide plate is a rear guide plate;

one of said drive-roll combinations includes a common shaft;

said drive rolls of said one drive-roll combination include a first drive roll and a second drive roll spaced apart one above another on said common shaft and each projecting through a respective one of said openings in said rear guide plate;

said first drive roll is a bottom drive roll disposed below said second drive roll and has a length matched to a smallest printed media format height;

said second drive roll is a top drive roll shorter than and disposed at distance from said bottom drive roll matching a largest usual printed media format height;

said first drive roll has a given envelope circle and an external contour with at least one projection extending over the length of said drive roll and parallel to an axis of rotation; and said second drive roll is a smooth spacer roll with an envelope circle identical to said given envelope circle.

7. The apparatus according to claim 1, wherein:

said guide plate is a rear guide plate;

said drive-roll combinations include first and second drive-roll combinations each having a common shaft;

said drive rolls of said first drive-roll combination include a first drive roll and a second drive roll spaced apart one above another on one of said common shafts and each projecting through a respective one of said openings in said rear guide plate, said first drive roll is a bottom drive roll disposed below said second drive roll and has a length matched to a smallest usual printed media format height, said second drive roll is a top drive roll shorter than and disposed at distance from said bottom drive roll matching a largest usual printed media format height, and said first and second drive rolls each have external contours with at least one identical projection extending over the length of said drive roll, parallel to an axis of rotation and formed of identical material;

said drive rolls of said second drive-roll combination include a first drive roll and a second drive roll spaced apart one above another on another of said common shafts and each projecting through a respective one of said openings in said rear guide plate, said first drive roll is a bottom drive roll disposed below said second drive roll and has a length matched to a smallest printed media format height; said second drive roll is a top drive roll shorter than and disposed at distance from said bottom drive roll matching a largest usual printed media format height; said first drive roll has a given envelope circle and an external contour with at least one projection extending over the length of said drive roll and parallel to an axis of rotation; and said second drive roll is a smooth spacer roll with an envelope circle identical to said given envelope circle;

said projections in said first drive-roll combination are formed of replaceable moldings of identical material with the same given coefficient of friction; and said at least one projection on said first drive roll of said second drive roll combination is also formed of a replaceable molding and has a coefficient of friction lower than said given coefficient of friction.

8. The apparatus according to claim 7, wherein said replaceable moldings of said projections of said first and second drive roll combinations are formed of polyurethane.

9. The apparatus according to claim 6, wherein said second drive roll is formed of a relatively hard commercial plastic.

10. The apparatus according to claim 9, wherein said commercial plastic is polyoxymethylene.

11. The apparatus according to claim 7, wherein said drive-roll combinations have parallel contours.

12. The apparatus according to claim 4, wherein said guide plate is a rear guide plate, and said drive-belt combination has identical drive belts disposed equidistantly one above another and projecting through associated openings formed in said rear guide plate.

13. The apparatus according to claim 4, wherein said backing-roll combination is disposed opposite said drive-belt combination and has identical backing rollers disposed equidistantly one above another on a rotatable shaft.

14. The apparatus according to claim 4, wherein said sliding-lever combination includes a two-armed lever.

15. The apparatus according to claim 12, wherein:

said backing-roll combination is disposed opposite said drive-belt combination and has identical backing rollers, said backing rollers are disposed equidistantly one above another on a rotatable shaft, and said backing rollers are disposed opposite gaps between said drive belts and outside said gaps; and said sliding-lever combination is disposed opposite said gaps between said drive belts, upstream of said backing rollers, and said sliding-lever combination includes a two-armed lever with free arms pointing in a direction opposite to a printed media transport direction.

16. The apparatus according to claim 12, including a drive-wheel combination having drive wheels, and an axially parallel deflection-wheel combination having deflection wheels, and said drive belts are disposed equidistantly on said drive wheels and said deflection wheels.

17. The apparatus according to claim 16, including smooth, freewheeling supporting wheels for said drive belts disposed between said drive-wheel combination and said deflection-wheel combination.

18. The apparatus according to claim 16, wherein:

said drive belts are toothed belts and said drive wheels and said deflection wheels are toothed wheels;

said drive wheels are fixed to a rotatable shaft; and said deflection wheels are fastened to a rotatable shaft.

19. The apparatus according to claim 13, including:

a dual support lever having free ends, fixed ends and a shaft, said shaft with said backing rollers firmly seated thereon being rotatably mounted on said free ends, said fixed ends being spring-mounted on said shaft of said dual support lever for rotation toward and away from said drive-belt combination, and said fixed ends having a tab in a pivoting range of a cam for pivoting away and locking said dual support lever; and said sliding-lever combination disposed on said shaft with said dual support lever and pivoted in the direction of said drive-belt combination by a sliding-friction clutch.

20. The apparatus according to claim 19, including a locking device having said cam, a lever for manually operating said locking device, and a rotatable shaft to which said lever and said cam are fixed.

21. The apparatus according to claim 20, wherein said backing-roll combination is disposed opposite said drive-belt combination and has identical backing rollers disposed equidistantly one above another on a rotatable shaft; and including an ejection-roll pair having rotatable shafts, a driven ejection roll fixed to one of said rotatable shafts, an indirectly driven ejection roll fixed to another of said rotatable shafts, a rotatable spring-mounted support lever on which said other rotatable shaft is mounted, and a coupling rod articulatingly connecting said rotatable spring-mounted support lever to said locking device for achieving simultaneous deactivation and locking together with said backing rollers.

22. The apparatus according to claim 21, wherein said indirectly driven ejection roll is shorter, by more than a largest envelope flap height of the printed media, than said driven ejection roll, and said indirectly driven ejection roll is flush with said driven ejection roll at the top.

23. The apparatus according to claim 4, wherein said sensor is disposed directly downstream of said backing-roller combination in a printed-medium transporting direction.

24. The apparatus according to claim 7, wherein:

said drive for said drive-roll combinations is a common, separate drive with freewheeling, said common drive includes:

a motor having a motor shaft with a first pinion thereon, a rigid shaft, an intermediate wheel rotatable on said rigid shaft, and a first toothed belt coupling said first pinion to said intermediate wheel;

a second freewheeling pinion fixed on said common rotatable shaft of said second drive-roll combination, and a second toothed belt coupling said intermediate wheel to said second pinion; and a third freewheeling pinion firmly fixed to said common rotatable shaft of said first drive-roll combination, and a third toothed belt coupling said second pinion to said third pinion.

25. The apparatus according to claim 3, wherein:

said separating elements include a drive-belt combination, a driven backing-roller combination matched to said drive-belt combination and a sliding-lever combination matched to and mounted upstream of said drive-belt combination, and said sensor is disposed in the vicinity of said backing-roller combination;

said drive-belt combination has identical drive belts disposed equidistantly one above another and projecting through associated openings formed in said rear guide plate;

a drive-wheel combination has drive wheels and a first rotatable shaft for said drive wheels;

an axially parallel deflection-wheel combination has a second rotatable shaft and deflection wheels on said second rotatable shaft;

said drive belts are disposed equidistantly on said drive wheels and said deflection wheels, smooth, freewheeling supporting wheels for said drive belts are disposed between said drive-wheel combination and said deflection-wheel combination, and said drive wheels are rigidly fixed to said first rotatable shaft and connected through said associated drive belts to said deflection wheels;

a third rotatable shaft to which said supporting wheels are fixed between said drive wheels and said deflection wheels, and a U-shaped supporting frame in which said first, second and third rotatable shafts are mounted;

said common drive for said drive-belt combination, said backing-roller combination, said sliding-lever combination and said ejection roll pair has a motor with a motor shaft, a first pinion on said motor shaft, an intermediate wheel fixed to said first rotatable shaft for said drive wheels, and a first toothed belt coupling said first pinion to said intermediate wheel;

a fixed shaft, a first drive pinion rotatably disposed on said fixed shaft, and a second toothed belt coupling said intermediate wheel to said drive pinion;

said backing-roll combination is disposed opposite said drive-belt combination and has identical backing rollers disposed equidistantly one above another on a fourth rotatable shaft;

a dual support lever has free ends, fixed ends and a fifth shaft, said fourth shaft with said backing rollers firmly seated thereon is rotatably mounted on said free ends, said fixed ends are spring-mounted on said fifth shaft of said dual support lever for rotation toward and away from said drive-belt combination, and said fixed ends have a tab in a pivoting range of a cam for pivoting away and locking said dual support lever;

said sliding-lever combination is disposed on said fifth shaft with said dual support lever and is pivoted in the direction of said drive-belt combination by a sliding-friction clutch;

a second drive pinion is fixed on said rotatable fifth shaft for said dual support lever for said backing-roller combination and said sliding-lever combination, a third toothed belt couples said first drive pinion to said second drive pinion;

a locking device has said cam, a lever for manually operating said locking device, and a sixth rotatable shaft to which said lever and said cam are fixed;

an ejection-roll pair has seventh rotatable shafts, a driven ejection roll fixed to one of said seventh rotatable shafts, an indirectly driven ejection roll fixed to another of said seventh rotatable shafts, a rotatable spring-mounted support lever on which said other seventh rotatable shaft is mounted, and a coupling rod articulatingly connecting said rotatable spring-mounted support lever to said locking device for achieving simultaneous deactivation and locking together with said backing rollers;

a second pinion is fixed together with said driven ejection roll to said one seventh rotatable shaft, a third toothed belt couples said first drive pinion to said second pinion;

a first spring has a given force, said dual support lever is mounted on said fifth shaft for rotation counter to said given force, said fourth rotatable shaft is disposed on said free ends of said dual support lever, and a third pinion and said backing rollers are fixed on said fourth rotatable shaft;

a second spring has a predetermined force, said sliding-lever combination is a two-armed lever mounted on said fifth shaft for rotation counter to said predetermined force through said sliding-friction clutch; and a transmission pinion is fixed to said fifth shaft and coupled through a fourth toothed belt to said third pinion.

26. The apparatus according to claim 1, wherein the printed media are letters or envelopes.

* * * * *